US005294113A

United States Patent [19]

Ladouceur et al.

[11] Patent Number: 5,294,113

[45] Date of Patent: Mar. 15, 1994

[54] HOCKEY STICK PROTECTOR

[75] Inventors: Eric Ladouceur, Alexandria; David Paavila; Jack Paavila, both of Green Valley, all of Canada

[73] Assignee: Jake Searches Inc., Green Valley, Canada

[21] Appl. No.: 916,612

[22] Filed: Jul. 22, 1992

[51] Int. Cl.[5] ..... A63B 59/14

[52] U.S. Cl. ..... 273/67 A

[58] Field of Search ..... 273/67 A; 280/825; 206/315.1, 315.2; 30/151, 153, 155; 150/154

[56] References Cited

U.S. PATENT DOCUMENTS

| | | | |
|---|---|---|---|
| 2,912,245 | 11/1959 | Gardner et al. | 273/67 A |
| 3,377,065 | 4/1968 | White, Sr. | 373/67 A |
| 3,458,194 | 7/1969 | Coles | 273/67 A |
| 3,529,825 | 9/1970 | White, Sr. | 273/67 A |
| 4,382,616 | 5/1983 | Oliveri | 280/825 |
| 4,392,674 | 7/1983 | Evon | 280/825 |
| 4,452,451 | 6/1984 | Dubreuil | 273/67 A |
| 4,651,990 | 3/1987 | Profit | 273/67 A |
| 4,653,753 | 3/1987 | Scarry | 273/67 A |
| 4,799,682 | 1/1989 | Hughes | 273/67 A |
| 5,174,567 | 12/1992 | Nordstrom | 273/67 A |

FOREIGN PATENT DOCUMENTS

| | | | |
|---|---|---|---|
| 755982 | 4/1967 | Canada | 273/67 A |
| 1206497 | 6/1986 | Canada | 273/67 A |
| 27842 | 8/1955 | Finland | 273/67 A |

*Primary Examiner*—Mark S. Graham

[57] ABSTRACT

Protector device for protecting the bottom edge of hockey sticks from wear when playing ball hockey on the road. The protector device can be in one or two protective pieces. The protective piece or pieces have a wearing surface that contacts the road when the piece or pieces are mounted on the hockey stick. A connector device provided on the protective piece or pieces for use in detachably mounting them on the blade of the hockey stick without damaging the blade so they can be readily removed when the stick is to be used for playing on an ice surface.

9 Claims, 4 Drawing Sheets

HOCKEY STICK PROTECTOR

BACKGROUND OF THE INVENTION

1. Field of the Invention

This invention is directed toward protector means for hockey sticks.

The invention is more particularly directed toward protector means for protecting the bottom edge of a hockey stick blade from wear.

2. Description of the Prior Art

Children often use their hockey sticks to play ball hockey on paved surfaces such as driveways or roads. The bottom of the stick rapidly wears away when used on such surfaces, making the stick too thin to be effectively used in playing hockey on ice, and eventually ruining the stick. To save their regular hockey sticks, children often purchase a plastic blade and attach it to a handle of a broken regular hockey stick to provide a stick suitable for ball hockey. These plastic-bladed sticks do not however have the same feel and action as a regular hockey stick.

Indoor ball hockey is becoming a popular summer sport. Players equipped in running shoes play ball-hockey in arenas on the concrete floor. Again however, regular hockey sticks wear out on the concrete. Also, many arenas do not permit regular hockey sticks to be used in ball hockey. The blades of the regular hockey sticks are normally taped to minimize splitting. The tape leaves scuff marks on the concrete floor which are difficult to clean off. Thus ball hockey players must use untaped hockey sticks which wear even more quickly, or they must purchase special, plastic-bladed sticks which again do not have the same feel and action as regular hockey sticks.

It is the purpose of the present invention to provide protector means for the blades of regular hockey sticks that prevents wear of the bottom edge of the blades when the sticks are used on surfaces other than ice.

The protector means can be made in one or two pieces. Connecting means are provided on the protector means for use in detachably connecting the protector means to the blade. The connecting means are designed to allow the player to easily and quickly attach the protector means to his stick when he wants to play ball hockey, and to easily and quickly remove the protector means when he wants to the stick by tape. The tape is wrapped in grooves in the protector means so it is not worn away when playing on a rough surface. The protector means is preferably made from a plastic material so that the protector means not only protects the hockey stick, but it also makes it easier to slide the sticks on the rough playing surface. With the protector means mounted on the hockey stick, it is the protector means that wears out and not the stick. The protector means is quite inexpensive compared to the stick and cheap to replace compared to replacing the hockey stick.

SUMMARY OF THE INVENTION

The invention is particularly directed toward a hockey stick protector means for protecting the bottom edge of the blade of the stick from wear when the stick is to be used on a play surface other than ice. The protector means has a wearing surface for contacting the play surface and covers at least the toe and heel areas of the bottom edge of the blade. Connecting means are provided on the protector means for use in detachably connecting it to the blade without damaging the blade so it can be readily removed when the stick is to be used for playing on an ice surface.

DESCRIPTION OF THE PREFERRED EMBODIMENTS

Figure 1:
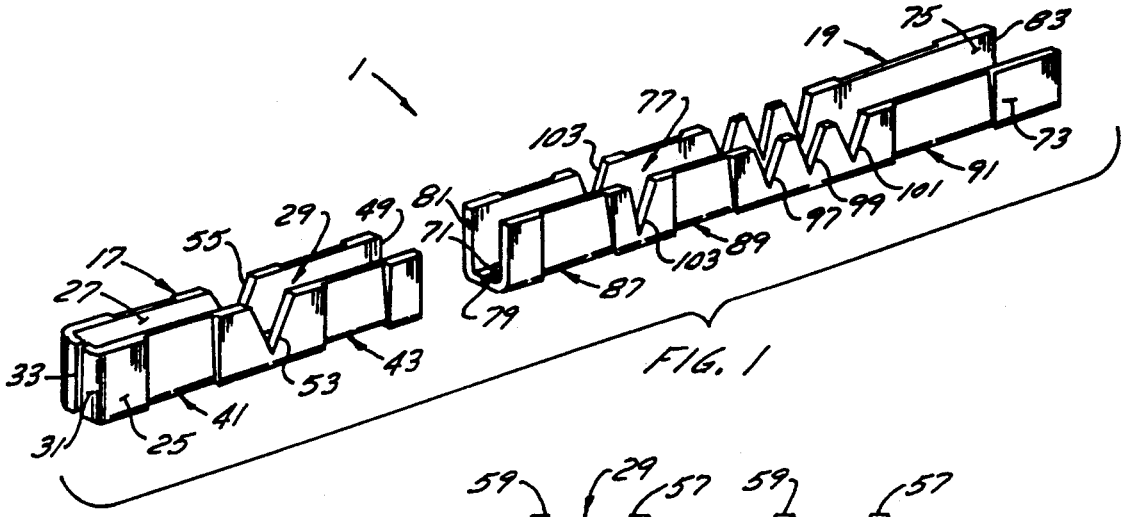
FIG. 1 is a perspective view of a preferred embodiment of the protector means.
Figure 4:
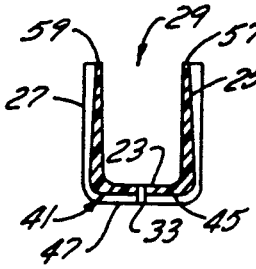
FIG. 4 is a cross-section view taken along lines 4—4 of FIG. 3.
Figure 5:
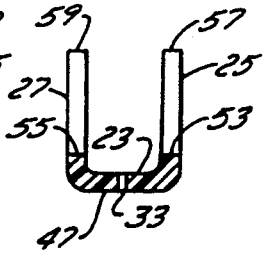
FIG. 5 is a cross-section view taken along line 5—5 of FIG. 4.
Figure 2:
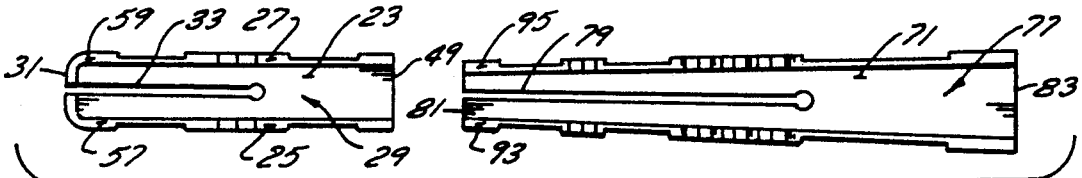
FIG. 2 is a top view of the protector means.
Figure 3:
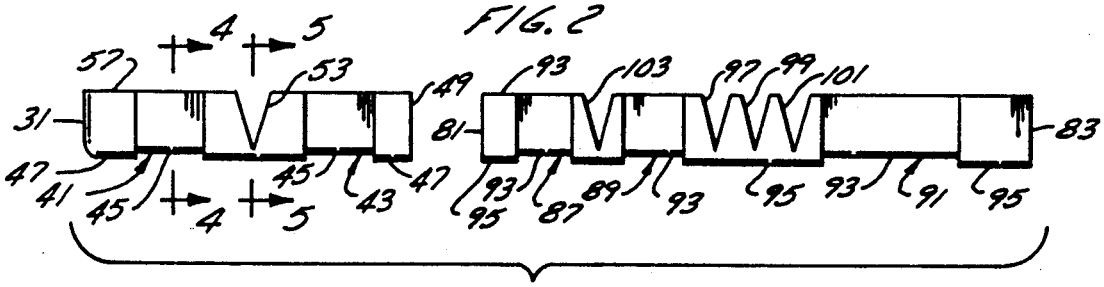
FIG. 3 is a side view of the protector means.
Figure 6:
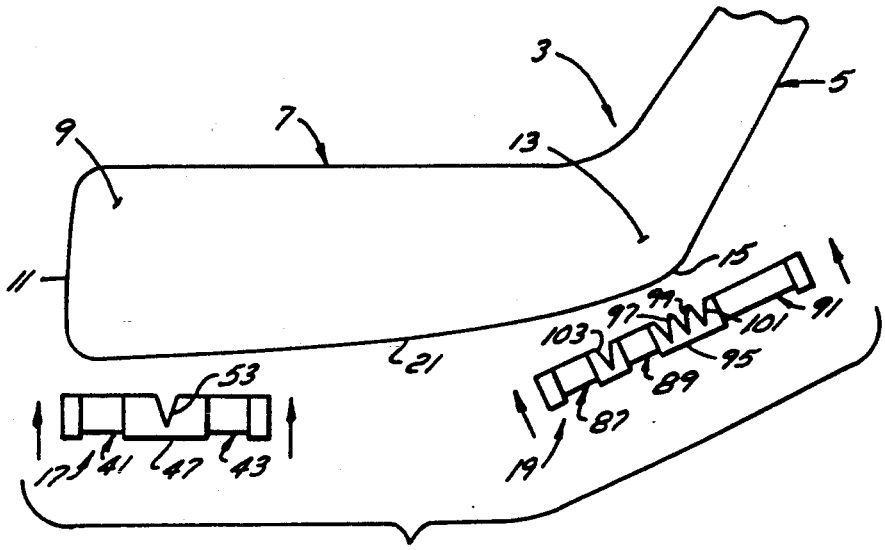
FIG. 6 is a side view of the protector being mounted on a hockey stick.

The hockey stick protector means 1 of the present invention as shown in FIGS. 1 to 5 is used with a regular hockey stick 3, shown in FIG. 6, having a shaft or handle 5, and a blade 7 which has a front toe portion 9 with a toe 11 and a rear heel portion 13 with a heel 15. The hockey stick protector means 1, in the preferred embodiment of the invention, is made in two pieces, a toe piece 17 and a heel piece 19. The toe and heel protector pieces 17, 19 fit over the bottom edge 21 of the blade 7 onto the blade in its toe and heel regions 9, 13.

The toe piece 17 has a U-shaped cross-section with a bottom wall 23 and upstanding side walls 25, 27. A slot 29 is defined between the side walls 25, 27 and the bottom wall 23 for receiving the blade 7 of the stick. The front end of the toe piece 17 has a front wall 31 joining the side walls 25, 27 and bottom wall 23. A narrow slit 33 can extend down through the center of the front wall 31 and along the center of the bottom wall 23 for about two thirds of its length. The slit 33 allows for some adjustment between the front portion of the side walls 25, 27 when mounted on the blade 7.

Means are provided on the top piece 17 for use in connecting the toe piece to the blade 7 of the hockey stick. The connecting means preferably comprises two, spaced-apart, wide, shallow grooves 41, 43 formed in the outer surface of the bottom wall 23. The grooves 41, 43 extend across the bottom wall 23 of the toe piece 17 and can extend up the side walls 25, 27 as well if desired. The bottom surface 45 of each groove 41, 43 is recessed from the outer surface 47 of the bottom wall 23. One groove 41 is located near the front wall 31 and the other groove 43 is located near the rear end 49 of the toe piece. The grooves 41, 43 have a width about twice the width of regular hockey tape.

The toe piece 17 is normally straight. Relief means are provided in the toe piece 17 to allow it to blend to generally follow the contour of the bottom edge 21 of the blade 7 in the toe region 9 if needed. The relief means can comprise at least one notch 53, 55 in each side wall 25, 27 of the toe piece 17 near the center of the toe piece between the grooves 41, 43. Each notch 53, 55 extends down from the top edge 57, 59 of the side walls 25, 27 to the bottom wall 23 and tapers inwardly from a wide mouth at the top edge of the side walls to a narrow bottom at the bottom wall 23. More than one notch could be provided in each side wall 25, 27 if more flexibility is required in the toe piece.

The heel piece 19 is constructed similarly to the toe piece 17 and has a U-shaped cross-section with a bottom wall 71 and upstanding side walls 73, 75. A slot 77 is defined between the side walls 73, 75 and the bottom wall 71. A narrow slit 79 can extend, from the front end 81 of the heel piece, in the center of the bottom wall 71 to about the center of the heel piece to provide some degree of lateral adjustment for the forward portion of the side walls 73, 75. The bottom wall 71 also tapers very slightly from the back end 83 toward the front end 81 to accommodate normal hockey stick construction.

Means are also provided in the heel piece 19 for use in connecting it to the blade 7 and shaft 5 of the hockey stick. The connecting means again comprise spaced-apart, wide shallow grooves formed in the outer surface of the bottom wall 71. The grooves extend across the bottom wall 71 and can continue up the side walls 73, 75 as well if desired. At least two, and preferably three, grooves 87, 89 and 91 are provided with two of the grooves 87, 89 closer to the front end 81 and one of the grooves 91 closer to the back end 83. The grooves 87, 89 have a width about one and a half times the width of hockey tape and groove 91 can have a width about twice the width of hockey tape. The bottom surface 93 of each groove is recessed from the bottom surface 95 of the bottom wall 71.

The heel piece 19 is normally straight. Relief means are provided allowing it to bend about the heel of the hockey stick. The relief means again can comprise notches formed in the side walls 73, 75, the notches extending down from the top edge 93, 95 of the side walls 73, 75 to the bottom wall 71 and tapering toward the bottom. Three notches 97, 99 and 101 can be provided in the central region of the heel piece 15 between the grooves 89, 91. In addition, a further notch 103 can be provided in the forward region of the heel piece between the forward grooves 87, 89. More notches can be provided if needed.

Figure 7:
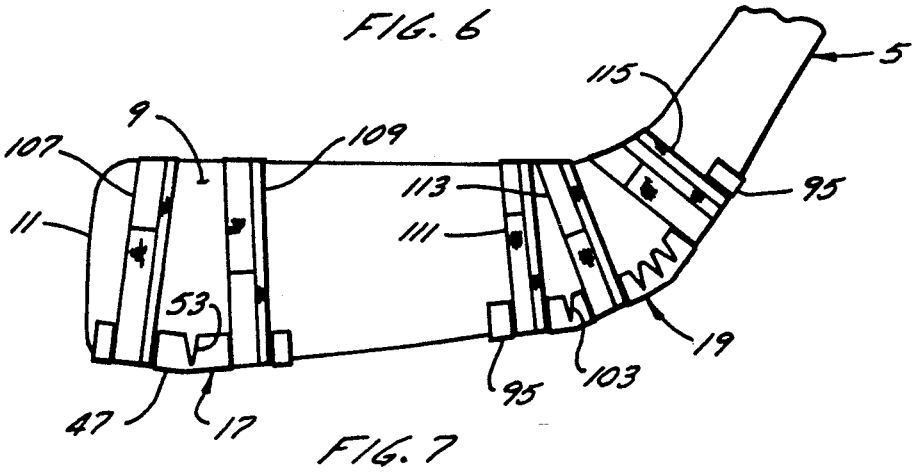
FIG. 7 is a side view of the protector mounted on the hockey stick.

The toe and heel pieces 17, 19 are mounted on the bottom edge of the blade 7 of the hockey stick 3 as shown in FIGS. 6 and 7. The toe piece 17 is mounted on the blade 7 in its toe region 9 with the blade sliding into the slot 29 and with the front wall 31 of the toe piece tight against the toe 11 of the blade. The bottom edge 21 of the blade is snug against the bottom wall 23 of the toe piece. The toe piece 17 is fastened to the blade 7 by wrapping a first strip 107 of hockey tape about the toe piece and blade in the forward groove 41, and a second strip 109 of hockey tape about the toe piece and blade in the rearward groove 43. The bottom slot 33 allows some adjustment of the forward portion of the side walls 25, 27 to accommodate variations in the width of the blade in its forward toe region. The toe piece 17 can be bent in the area of notches 53, 55 to generally follow the curvature of the bottom edge 21 after the first tape strip 107 is applied. The second tape strip 109 holds the toe piece in the bent position.

The heel piece 19 is similarly mounted on the blade with the blade sliding into the slot 77. The heel piece 19 is located to have its central notches 97 to 101 centered with respect to the heel 15 of the stick. The bottom edge 21 of the blade in the heel region 13 is snug against the bottom wall 71 of the heel piece 19. First and second strips 111, 113 of hockey tape are wrapped about both the heel piece 19 and the blade 7 in the two forward grooves 87, 89. The heel piece 19 can be slightly bent about the forward notch 103 between the grooves 87, 89 to follow the contour of the bottom edge 21 if desired. After the forward portion of the heel piece 19 is fastened to the blade, the rear portion can be bent about the heel because of notches 97 to 101 to place the heel piece snug against the lower back portion of the shaft 5 and a tape strip 115 is wrapped about both the heel piece and the shaft in rear groove 91 to hold the heel piece to the shaft. The bottom slit 79 allows some adjustment of the side walls 73, 75 in the heel portion of the blade to accommodate blade width variations.

The bottom edge 21 of the blade 7 of the stick 3 is now protected against scraping damage when playing road hockey. While the central portion of the blade is unprotected, the bottom walls 23, 71 of the heel and toe pieces are thick enough to prevent the central portion of the blade from contacting the road. The tape strips, which hold the protective pieces in place, are located in grooves and do not contact the road. The grooves are wide enough to allow several turns of tape to be wrapped about the hockey stick in each groove in overlapping fashion thus providing more adhesion to more securely hold the protective pieces on the stick. It will be seen that it is the flat bottom surfaces 47 and 95 respectively of the toe and heel protective pieces 17, 19 that wear out during ball hockey play and not the bottom edge 21 of the blade.

Since the protective pieces are used primarily when playing ball hockey, they are made short enough so as not to interfere with the ball when it makes normal contact with the blade. With the smallest ball size used in ball hockey being about two inches, the protective pieces would have a height of no more than about five-eights of an inch. When it is desired to use the stick on ice the tape strips are removed by unwrapping them, or cutting them and peeling them off the stick and protective pieces. This allows the protective pieces to be slipped off, and the stick to be used normally.

Figure 8:
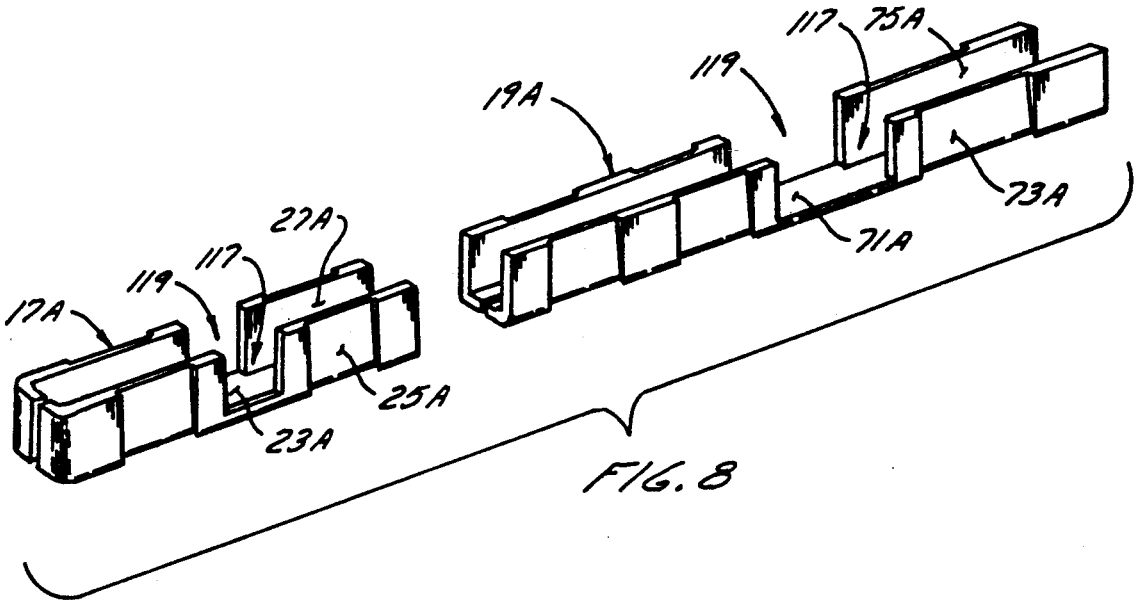
FIG. 8 is a perspective view of another embodiment of the protective means.

Many modifications can be made to the protective pieces. In one embodiment, shown in FIG. 8, both the toe and heel pieces 17A, 19A can have a central portion of the side walls 25A, 27A and 73A, 75A cut away as shown at 117, 119 to provide the bending relief means. This leaves only the bottom wall 23A, 71A in the central region of the protective pieces 17A, 19A forming a strap section that can be easily bent to follow the curvature of the bottom edge of the blade.

Figure 9:
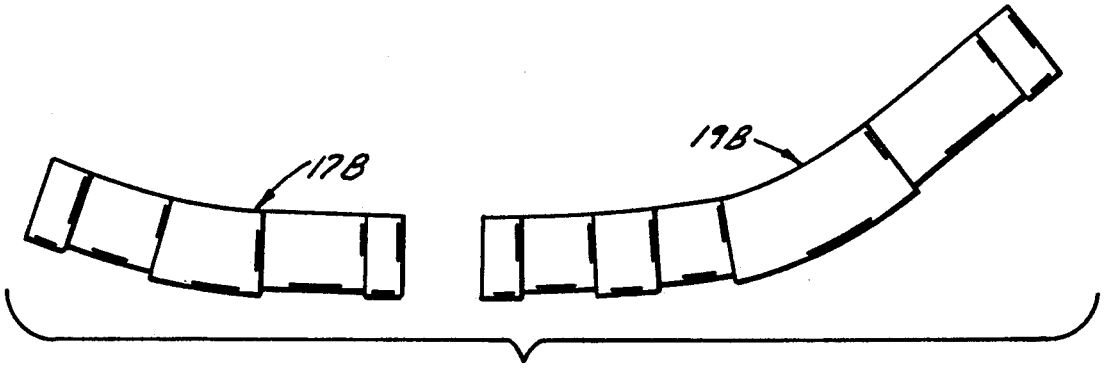
FIG. 9 is a side view of a further embodiment of the protective means.

In another embodiment of the invention, shown in FIG. 9, the protective toe and heel pieces 17B, 19B can be made already bent or curved to fit the curvature of the bottom edge of the blade. The relief means, in the form of the notches, can be eliminated or at least reduced. However hockey sticks are made with many types of curvatures in both the toe and heel regions and it is difficult to find one curvature for both the toe and heel pieces that will properly fit all the types of curvatures employed in hockey sticks.

Figure 10:
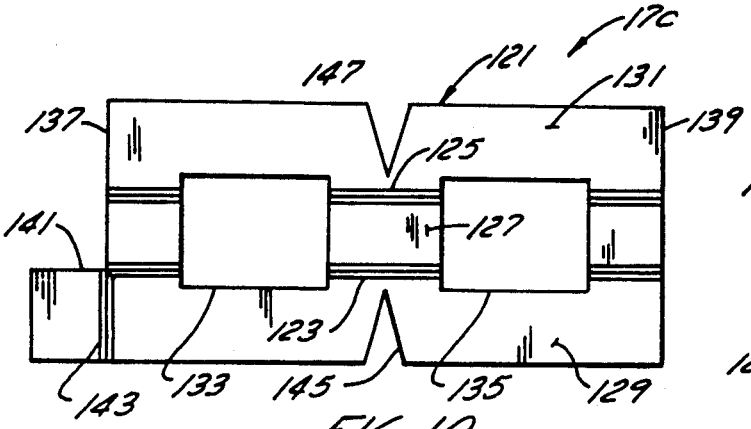
FIG. 10 is a top view of the toe piece of yet another embodiment of the protective means.
Figure 12:
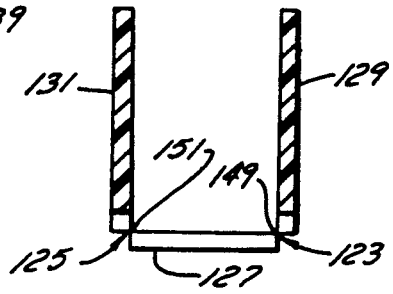
FIG. 12 is a cross-section view taken along line 12—12 in FIG. 11.
Figure 11:
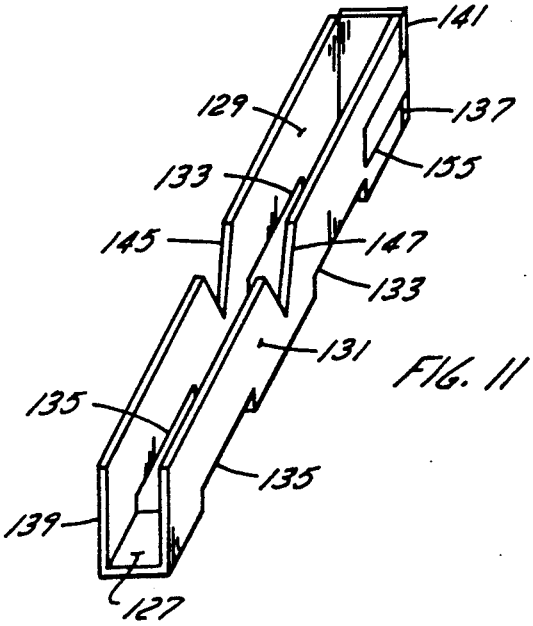
FIG. 11 is a perspective view of the assembled toe-piece of FIG. 10.

In another embodiment of the invention the protective toe and heel pieces can be produced in flat form, from a flat sheet, and provided with longitudinal hinges allowing the flat pieces to be bent into a U-shape. As shown in FIGS. 10 to 12, the toe piece 17C is formed from a flat, generally rectangular, sheet member 121 having two parallel longitudinal grooves 123, 125 formed in its inner surface. The grooves 123, 125 divide the flat member 121 into a bottom wall section 127 and side wall sections 129, 131. Cutouts 133, 135 are made in the bottom wall section 127 near the front and rear ends 137, 139 of the member 121. The cutouts 133, 135 extend slightly into the side wall sections 129, 131 and provide the connecting means for use in connecting the toe piece to the blade of the stick. A flap 141 is provided at the front end 137 on one of the side wall sections 129 with a groove 143 delimiting the flap 141 from the section 129. Relief means in the form of notches 145, 147 can be provided in the side wall sections 129, 131 located between the cutouts 133, 135.

The flat member 121 is formed into a U-shaped toe piece 17C by folding the side wall sections 129, 131 about the grooves 123, 125 which define hinges 149, 151. The flap 141 is also folded about groove 143, which defines a hinge to abut the front end of the other side wall section 131 to form a front wall. A strip of tape 155 extending from side wall 129 to sidewall 131 across flap 141 holds flap 141 in place. The U-shaped toe piece 17C is now snugly mounted onto the hockey stick blade and held there by wrapping tape strips about both the blade and toe piece in the area of the cutouts 133, 135. The cutouts 133, 135 locate the tape strips inwardly of the outer surface of the bottom wall section 127 so they don't contact the road during use and wear out. The heel piece (not shown) can be made in a similar manner from a flat member. Both the toe and heel pieces can also be made with cut away portions in the side walls, replacing the notches, to provide bending relief means if desired.

Figure 13:
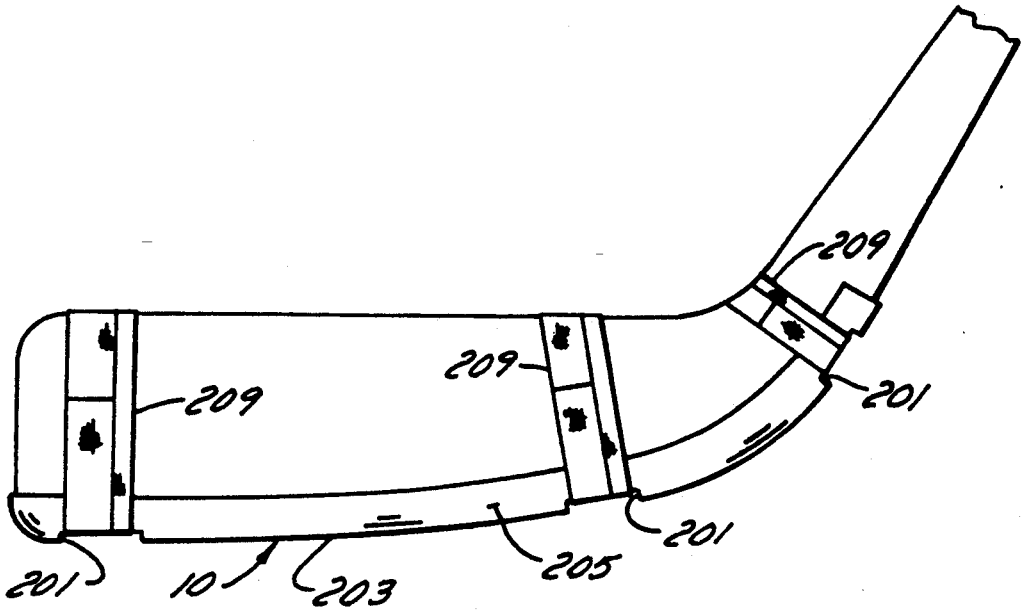
FIG. 13 is a side view of one embodiment of a one-piece protector mounted on a hockey stick.

The hockey stick protector means has been made in two pieces. This allows for variations in the length of the blade of the hockey stick, variations in the shape and curvature of the blade, and also allows the protector means to be used with left or right hand sticks. However it is contemplated that the protector means can also be made in one piece, moulded to fit both the curvature of the blade when viewed from the top and the curvature of the bottom edge of the blade when viewed from the side. As shown in FIG. 13, the one-piece protector 1D, having a U-shaped cross-section, has shallow, wide grooves 201 in its bottom wall 203 which can extend up in the side walls 205. The protector 1D is slipped onto the blade over its bottom edge and tape strips 209 are wrapped about both the protector 1D and the blade, in the grooves 201 to fasten the protector to the blade.

Figure 14:
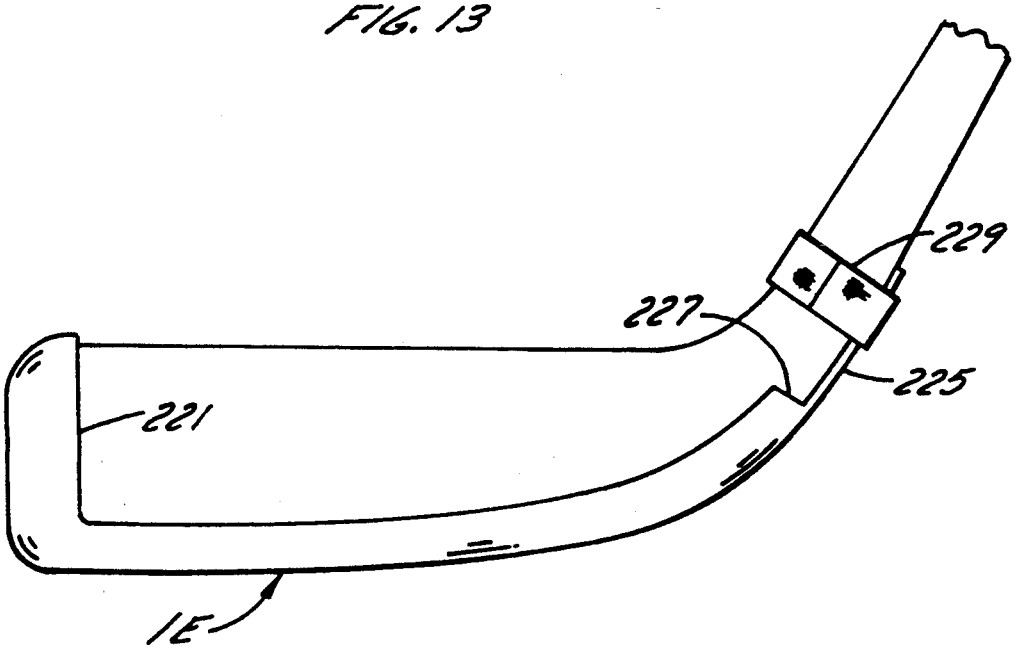
FIG. 14 is a side view of another embodiment of a one-piece protector mounted on a hockey stick.

Means other than tape strips could be used to fasten the one-piece moulded protector to the hockey stick. By way of example, and as shown in FIG. 14, the protector 1E, similar to protector 1D, could be made with an integral cap 221 at its front end which fits over the toe of the blade. A tail 225 extends from the rear end 227 of the protector up the back of shaft 5 of the stick. A fastening tape 229 is attached to the tail 225 to wrap about the shaft. The tape 229 can be a "velcro" (registered trademark) tape that fastens to itself. The tape 229 and cap 221 securely hold the protector 1E to the hockey stick eliminating the need for tape grooves in the protector, and tape strips.

The protectors, whether in one or two pieces, can be moulded or otherwise formed from suitable plastic material such as nylon or polyurethane. The protectors shown in FIGS. 1, 8, 9, 13 and 14 can be injection moulded for example. The materials are selected for their wear and flexibility.

We claim:

1. Hockey stick protector means for protecting the bottom edge of the blade of the stick from wear when the stick is used on a play surface other than ice, the protector means comprising: at least one elongated, slotted member having a u-shaped cross-section defined by side walls and a bottom wall and adapted to cover at least one of the toe and heel areas of the bottom edge of the blade of a hockey stick; and connecting means integral with the member for use in detachably connecting the member to a blade of a hockey stick without damaging the blade, the connecting means comprising at least two wide, spaced-apart, shallow grooves formed in the outer surface of the bottom wall of the member, the grooves extending transversely across the bottom wall and being at least as wide as the width of hockey tape.

2. Hockey stick protector means as claimed in claim 1 comprising two elongated, slotted members, one of the members being a toe member for protecting the toe portion of the blade and the other member being a heel member for protecting the heel portion of the blade.

3. Hockey stick protector means as claimed in claim 1 comprising one elongated, slotted member long enough to cover the bottom edge of the blade of the hockey stick including the toe and heel areas.

4. Hockey stick protector means as claimed in claim 2 wherein the toe and heel members are moulded to generally fit the curvature of the blade in its toe and heel portions respectively.

5. Hockey stick protector means as claimed in claim 3 wherein the member is moulded to generally fit the curvature of the bottom edge of the hockey stick blade.

6. Hockey stick protector means as claimed in claim 2 wherein the toe and heel members are normally straight, each member having relief means in its side walls allowing the members to be bent when installing them on the blade so as to generally follow the curvature of the bottom edge of the blade.

7. Hockey stick protector means as claimed in claim 6 wherein the relief means comprise at least one v-shaped notch in each side wall, the notches extending down to the bottom wall.

8. Hockey stick protector means as claimed in claim 6 wherein the relief means in the heel member comprise at least three, closely adjacent, v-shaped notches in each side wall, the notches extending down to the bottom wall.

9. Hockey stick protector means as claimed in claim 1 wherein the side walls of the member have a low height that normally prevents contact of the member, when mounted on a hockey stick, with about a two inch diameter ball when the ball is struck by the hockey stick.

* * * * *